US009744414B2

(12) United States Patent
Jertson

(10) Patent No.: US 9,744,414 B2
(45) Date of Patent: Aug. 29, 2017

(54) GOLF CLUB WITH PROGRESSIVE TAPERED FACE THICKNESS

(71) Applicant: Karsten Manufacturing Corporation, Phoenix, AZ (US)

(72) Inventor: Marty R. Jertson, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 16 days.

(21) Appl. No.: 14/943,891

(22) Filed: Nov. 17, 2015

(65) Prior Publication Data

US 2016/0067559 A1 Mar. 10, 2016

Related U.S. Application Data

(60) Continuation of application No. 14/184,220, filed on Feb. 19, 2014, now Pat. No. 9,199,142, which is a division of application No. 13/195,668, filed on Aug. 1, 2011, now Pat. No. 8,672,722, which is a continuation-in-part of application No. 12/340,523, filed on Dec. 19, 2008, now Pat. No. 7,988,564.

(51) Int. Cl.
*A63B 53/00* (2015.01)
*A63B 53/04* (2015.01)

(52) U.S. Cl.
CPC ..... *A63B 53/047* (2013.01); *A63B 53/00* (2013.01); *A63B 53/0475* (2013.01); *A63B 2053/005* (2013.01); *A63B 2053/0408* (2013.01); *A63B 2053/0462* (2013.01); *A63B 2053/0479* (2013.01); *Y10T 29/49* (2015.01)

(58) Field of Classification Search
CPC ... A63B 53/00; A63B 53/047; A63B 53/0475; A63B 2053/0408; A63B 2053/0462; A63B 2053/005; A63B 2053/0479; Y10T 29/49
See application file for complete search history.

(56) References Cited

U.S. PATENT DOCUMENTS

| | | | |
|---|---|---|---|
| 3,655,188 | A | 4/1972 | Solheim |
| 3,984,103 | A | 10/1976 | Nix |
| 4,417,731 | A | 11/1983 | Yamada |
| 4,432,549 | A | 2/1984 | Zebelean |
| 4,715,601 | A | 12/1987 | Lamanna |
| 5,423,535 | A | 6/1995 | Shaw et al. |
| 5,669,824 | A | 9/1997 | Aizawa et al. |
| 6,554,719 | B2 | 4/2003 | Peters |
| 6,623,374 | B1 | 9/2003 | Helmstetter et al. |
| 6,743,117 | B2 | 6/2004 | Gilbert |
| 7,083,530 | B2 | 8/2006 | Wahl et al. |
| 7,614,962 | B1 | 11/2009 | Clausen |
| 2003/0153397 | A1 | 8/2003 | Roach |
| 2005/0101410 | A1 | 5/2005 | Bonneau |
| 2007/0117651 | A1 | 5/2007 | Belmont |

*Primary Examiner* — Stephen Blau

(57) ABSTRACT

Embodiments of a golf club set with progressive tapered face thickness coordinated with club loft are generally described herein. Other embodiments may be described and claimed.

6 Claims, 4 Drawing Sheets

| IRON LOFT (DEG.) | CASE 1 | CASE 2 | CASE 3 | CASE 4 | MIN | MAX |
|---|---|---|---|---|---|---|
| 15 | -5 | -5.5 | 0 | -7 | -9 | 0 |
| 20 | -3.5 | -3 | 0 | -5 | -7 | 1.2 |
| 30 | -0.5 | 1 | 1 | -2 | -4 | 4.25 |
| 40 | 2 | 4 | 2 | 0 | -1 | 6 |
| 50 | 4.5 | 5.5 | 3 | 1 | 0 | 7.5 |
| 60 | 7 | 6 | 4 | 2 | 0 | 8 |
| 65 | 8 | 6.1 | 4.25 | 2.5 | 0 | 8 |

| IRON LOFT (DEG.) | CASE 1 | CASE 2 | CASE 3 | CASE 4 | MIN | MAX |
|---|---|---|---|---|---|---|
| 15 | -5 | -5.5 | 0 | -7 | -9 | 0 |
| 20 | -3.5 | -3 | 0 | -5 | -7 | 1.2 |
| 30 | -0.5 | 1 | 1 | -2 | -4 | 4.25 |
| 40 | 2 | 4 | 2 | 0 | -1 | 6 |
| 50 | 4.5 | 5.5 | 3 | 1 | 0 | 7.5 |
| 60 | 7 | 6 | 4 | 2 | 0 | 8 |
| 65 | 8 | 6.1 | 4.25 | 2.5 | 0 | 8 |

| Iron Loft (deg) | Example 1 | Example 2 | MAX | Middle | MIN |
|---|---|---|---|---|---|
| 15 | -3.00 | -6.00 | -1.5 | -4.75 | -8.00 |
| 20 | -2.75 | -5.50 | -1.3 | -4.15 | -7.00 |
| 30 | -2.50 | -4.50 | -1.1 | -3.55 | -6.00 |
| 40 | -2.00 | -3.50 | -0.8 | -2.9 | -5.00 |
| 50 | -1.75 | -3.00 | -0.5 | -2.25 | -4.00 |
| 60 | -1.50 | -2.50 | -0.2 | -1.7 | -3.20 |
| 65 | -1.25 | -2.25 | -0.1 | -1.55 | -3.00 |

| Iron Loft (deg) | Example 1 | Example 2 | MIN1 | Middle | MAX2 |
|---|---|---|---|---|---|
| 15 | 0.50 | 0.75 | 0.025 | 0.513 | 1.00 |
| 20 | 0.75 | 1.70 | 0.125 | 1.188 | 2.25 |
| 30 | 1.25 | 3.50 | 0.325 | 2.413 | 4.50 |
| 40 | 2.00 | 5.00 | 0.525 | 3.388 | 6.25 |
| 50 | 2.75 | 6.10 | 0.725 | 4.113 | 7.50 |
| 60 | 3.50 | 7.00 | 0.925 | 4.463 | 8.00 |
| 65 | 4.00 | 7.25 | 1.025 | 4.513 | 8.00 |

GOLF CLUB WITH PROGRESSIVE TAPERED FACE THICKNESS

CROSS REFERENCE TO APPLICATIONS

This is a continuation of U.S. patent application Ser. No. 14/184,220, filed Feb. 19, 2014, which is a divisional of U.S. patent application Ser. No. 13/195,668, filed Aug. 1, 2011, now U.S. Pat. No. 8,672,722, which is a continuation-in-part of U.S. patent application Ser. No. 12/340,523, filed Dec. 19, 2008, now U.S. Pat. No. 7,988,564, the contents of which are fully incorporated herein by reference.

TECHNICAL FIELD

This application relates generally to golf clubs, and more particularly, to sets of golf clubs.

BACKGROUND

A set of golf clubs may include various types of golf clubs. For example, a set of golf clubs may include a driver-type golf club, one or more fairway wood-type golf clubs, one or more hybrid-type golf clubs, one or more iron-type golf clubs, one or more wedge-type golf clubs, and/or a putter-type golf club. In one example, a set of iron-type golf clubs may include long iron-type golf clubs, middle iron-type golf clubs, and/or a short iron-type golf clubs. Although a set of iron-type golf clubs may be matched for generally uniform performance, an individual may mis-hit his or her iron shots differently depending on whether a long iron-type golf club, a middle iron-type golf club, or a short iron-type golf club is used. Adjustments to the center of gravity of the club head may improve the performance and feel of various iron-type golf clubs.

DRAWINGS

DESCRIPTION

A set of golf clubs may include various types of golf clubs. In particular, a set of golf clubs may include one or more iron-type golf clubs such as long, middle and short irons. In one example, the long irons may comprise irons numbered 1, 2, 3 and 4, which may have loft angles ranging from approximately 15° or 16° for a 1-iron, 17° or 18° for a 2-iron, 19°, 20° or 21° for a 3-iron, 22°, 23° or 24° for a 4-iron. Middle irons may include irons numbered 5 having loft angles of about 26°, 27°, or 28°, and a 6-iron having a 29°, 30°, or 31°, respectively. Short irons may include irons numbered 7, 8 and 9 along with pitching wedges, sand wedges and lob wedges, with lofts ranging from about 32°, 33°, or 34° for the 7-iron, about 36°, 37°, or 38° for the 8-iron, about 40°, 41°, or 42.5° for the 9-iron and up to about 60° or even 65° for the wedges.

Although iron-type golf clubs may be described above in a particular manner, iron-type golf clubs may be defined in other suitable manners. For example, iron-type golf clubs may not include wedge-type golf clubs as described above. In particular, long irons may include 1-irons, 2-irons, and 3-irons whereas middle irons may include 4-irons, 5-irons, and 6-irons while short irons may include 7-irons, 8-irons, and 9-irons. The methods, apparatus, and articles of manufacture described herein are not limited in this regard.

The various numbered irons may produce different ball flight distances for an individual. For example, an individual may get 10-15 yards more distance with a 3-iron than with a 4-iron, and 10-15 yards more distance with a 2-iron than with a 3-iron, etc.

Iron-type golf clubs may include various shapes, configurations, etc. In particular, cavity-back iron-type golf clubs may include an empty space, or cavity, behind the center of the club face. The material in the club head is placed in the club face and around the periphery of the club head behind the club face. This weight distribution increases the moment of inertia about the vertical axis of the club head's center of gravity, which may result in less twisting of the club from a mis-hit. Consequently, a more forgiving result if the ball is struck off the club head's center of gravity may be obtained. With much of the weight of the cavity back club head in the club face, changes in the configuration of the club face may have significant effects on the position of the center of gravity.

Figure 1:
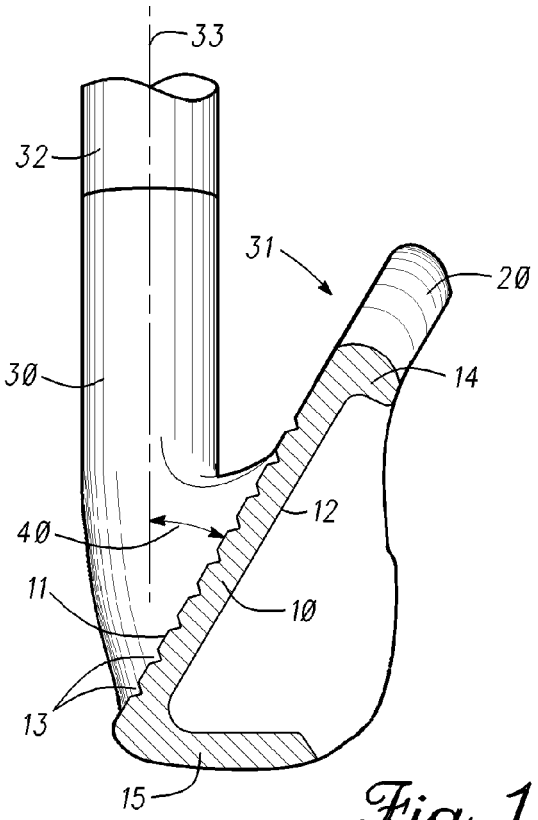
FIG. 1 is a cross section view of a cavity-back iron-type golf club head.

FIG. 1 illustrates a cross sectional view of an example cavity-back middle iron-type club head (31). The club head (31) may include a club face (10), peripheral weighting mass (20) and a hosel (30). The club face (10) has a front or striking surface (11), with one or more grooves (13), a rear surface (12), a top portion (14) and a bottom or sole portion (15). The peripheral weighting mass (20) positioned around the club face (10). The hosel (30) may connect the club head (31) to shaft (32). The loft angle of the club head (31) may be an angle defined by the front surface (40) and the centerline (33) of the shaft (32) and hosel (30).

The optimal trajectory of a golf shot occurs when the center of the club face (10) strikes the center of a ball. Individuals may mis-hit their long irons by striking the center of the ball with the lower portion of the club face (10), which results in a lower trajectory and less distance. This is known as hitting the shot "thin." Performance of a long iron hit thin can be improved by lowering the center of gravity of the club head (31) so it is below the center of the club face (10).

With more of the mass below the center of the club face (10), more energy may be transferred near the center of the ball. The shot may feel more solid and/or travel farther. In addition, a lower center of gravity on the club head (31) may result in a higher trajectory to the ball and improve the distance of the shot.

By contrast, higher lofted clubs are commonly mis-hit high on the club face (10), producing more elevation and less distance than the optimal performance of the club. The difference in the characteristic mis-hit between the long and short irons may be attributed to differences in shaft length (e.g., shorter shafts on the short irons) and the psychological effect of what an individual is trying to accomplish (e.g., hit for distance or pitch a high, arching shot).

Short irons may be made to provide more forgiveness for high mis-hits by moving the center of gravity of the club head (31) upward. The effect of placing more mass at the actual contact point may lower the trajectory so the ball travels farther in the air. Also, a higher center of gravity may provide more backspin on the ball to give the desired effect of stopping the ball more quickly when it lands.

A desirable characteristic of a set of irons is to provide a "matched" feel so that an individual has the sensation that the same swing may be effective with all of the clubs. Varying the center of gravity by changes in the club head (31) may achieve a matched feel while providing differing physical condition from club to club in the set. Because much of the mass of the club head (31) is contained in the club face (10), the center of gravity of the club head (31) can readily be moved by tapering, or varying the thickness of the club face (10). Changing the taper from club to club in the set positions the center of gravity in each club to compensate for mis-hits with that club.

Figure 2:
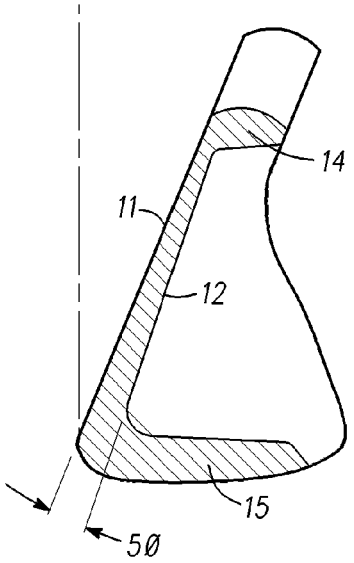
FIG. 2 is a cross section of a long iron-type golf club incorporating a tapered face having a negative taper angle.
Figure 3:
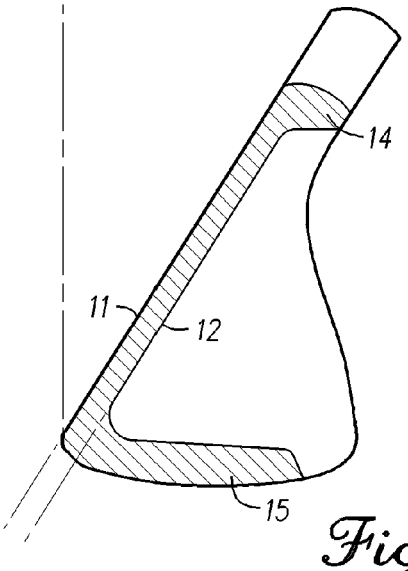
FIG. 3 is a cross section of a mid iron-type golf club incorporating a face with no taper.
Figure 4:
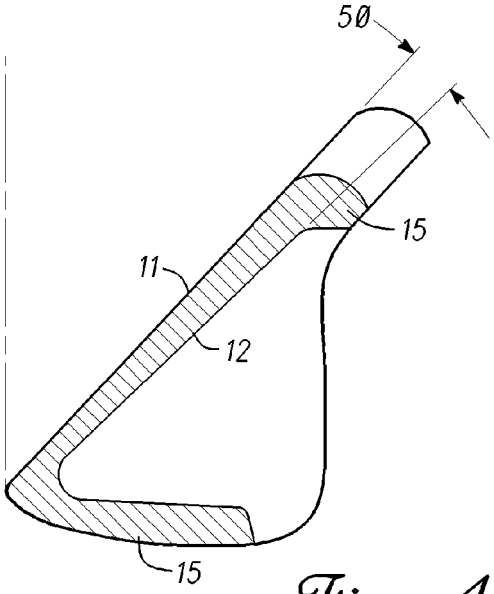
FIG. 4 is a cross section of a short iron-type golf club incorporating a tapered face having a positive taper angle.

FIGS. 2, 3 and 4 show cross sections of an example long iron (e.g., a 16° loft angle), an example middle iron (e.g., a 30° loft angle) and an example short iron (e.g., a 42° loft angle), respectively. The rear surface (12) of the club face (10) is tapered relative to the front surface (11) at a selected angle (50). In the example of FIG. 2, the rear surface (12) is tapered so the club face (10) is wider at the bottom portion (15) than the top portion (14). Consequently, more mass may be distributed lower on the club head (10) to lower the center of gravity.

FIG. 3 illustrates a middle iron with the front surface (11) and the rear surface (12) being parallel to each other (i.e., no taper). In particular, the thickness of the club face (10) may be uniform between the top portion (14) and the bottom portion (15). FIG. 4 illustrates a short iron in which the rear surface (12) is tapered so the club face (10) is wider at the top portion (14) than at the bottom portion (15), which may distribute more mass higher on the club head (31) and raise the center of gravity toward the top portion of the face.

Taper angle (50) measures the relative orientation of the front surface (11) and the rear surface (12) of the club face (10). In order to distinguish the cases in which the top portion (14) is thicker from those in which the bottom portion (15) is thicker, a terminology convention is useful. In the description that follows, a negative-taper angle is a taper angle wherein a portion of the club face (10) at or proximate to the bottom portion (15) is thicker than a portion of the club face (10) at or proximate to the top portion (14) (e.g., FIG. 2). A zero-taper angle is a taper angle with the front and rear surfaces (11, 12) of the club face (10) being parallel (e.g., FIG. 3) so that the thickness of the club face (10) is uniform between the top portion (14) and the bottom portion (15). In contrast to a negative-taper angle and a zero-taper angle, a positive taper angle is a taper angle in which a portion of the club face (10) at or proximate to the top portion (14) is thicker than a portion of the club face (10) at or proximate to the bottom portion (15) (e.g., FIG. 4). Choosing a different convention in which, for example, a configuration wherein the bottom portion (15) of the club face (10) is thicker than the top portion (14) is defined to have a positive-taper angle, is equally acceptable.

Golf club irons are made in sets with progressively increased loft angles. For example, some sets of irons may include 2-irons through 9-irons whereas other sets may also include 1-irons. Some manufacturers provide specialty sets that include a smaller number of iron-type clubs, such as 5-irons through 9-irons. In another example, a specialized set could be as few as only two or three clubs. No standard specifies the loft associated with any particular numbered club, but generally the loft angles may be those described above. As described in detail below, a matched set of irons with tapered club faces may incorporate progressively increasing taper angles from the lowest loft angle in the set to the highest loft angle.

The progression of the taper angles relative to the loft angles in a set of clubs may be linear or non-linear. Different progressions may be implemented depending upon the type of individual for whom a club set is designed. The progression of loft angles may be linear or non-linear, and the corresponding taper angles may be positive, zero, or negative, or a combination thereof including club sets that lack a 0° taper angle.

Figures 5, 6:
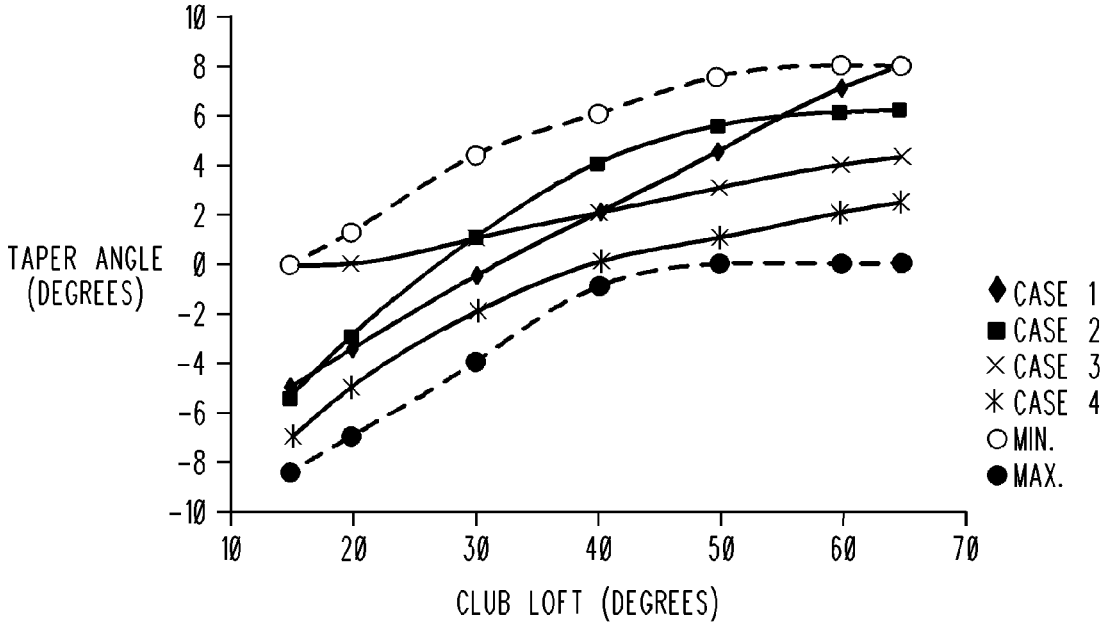
FIG. 5 is a graphical representation of the data in FIG. 6.
FIG. 6 is a table associated with club loft and taper angle.

A table of sample ranges of taper angles versus loft angles is shown in FIG. 6. In each designated case, seven representative loft angles are paired with corresponding taper angles. In one example, a set of iron-type golf clubs may be configured by selecting loft angles between 15° and 65° for the individual. A full set may generally comprise as few as five clubs or as many as 12 clubs, and the loft angle for a particular club does not necessarily have to be an even multiple of five or ten degrees as shown in FIG. 6.

FIG. 5 graphically illustrates the taper angle versus the loft angle of the clubs in FIG. 6. To determine for a given case the taper angle corresponding to a selected loft angle (such as 28° for a 6-iron), a value may be extracted from the graph of FIG. 5 or determined by interpolating between two set points in FIG. 6. Although the graph and table of FIGS. 5 and 6 may be used to derive an appropriate taper angle for a given loft angle, the relationship may also conveniently be expressed as an equation, as discussed below.

Case 1 in FIGS. 5 and 6 is an example of a set of clubs exhibiting a linear relationship between loft and taper angles. For example, this set of clubs may be effective for a novice or beginner who tends to hit a low trajectory. The relationship may be expressed as $t=\frac{1}{4}L-8$, where t is the taper angle in degrees, and L is the loft angle in degrees. In one example, a 6-iron with a loft angle of 28° may include a taper angle of −1°, which means a portion of the club face (10) at or proximate to the top portion (14) may be smaller than a portion of the club face (10) at or proximate to the bottom portion (15). In another example, a 42° 9-iron may include a +2.5° taper angle (e.g., a portion of the club face (10) at or proximate to the top portion (14) may be larger than a portion of the club face (10) at or proximate to the bottom portion (15)). The methods, apparatus, and articles of manufacture described herein are not limited in this regard.

Similar design parameters may be extracted for other cases in FIGS. 5 and 6. Case 3 is also linear, and may be made for a skilled individual with a medium or low natural trajectory. In this example, the club set may include a 3-iron (e.g., a loft angle of 20° or 21°) having a zero-taper angle. The higher lofted clubs have positive taper angles following the relationship $t=\frac{1}{10}L-2$. For example, a 42° 9-iron may have a +2.5° taper angle, and a 28° 7-iron may have a +0.8° taper angle. The methods, apparatus, and articles of manufacture described herein are not limited in this regard.

Cases 2 and 4 exhibit non-linear relationships between the loft angle and the taper angle. As shown in FIG. 5, case 2, which may be advantageous to a novice or intermediate-level individual with a medium natural trajectory, incorporates a positive taper angle (raising the center of gravity) in a 6-iron club (e.g., about 30° loft) and clubs with a higher loft angle than the 6-iron. Case 4, which might represent a set of clubs for an intermediate-level individual with a high natural trajectory, incorporates a negative taper angle (lowering the center of gravity) for all clubs with loft angles less than the loft angle of a 9-iron, and a positive taper angle for wedges. Other particular taper angles corresponding to selected loft angles in case 2 or case 4 may be interpolated from FIG. 6 or the graph in FIG. 5. The curvilinear relationships represented by the data and the graphs for cases 2 and 4 may be approximated by third-order equations. For case 2, the taper angle may be found by computing $t=0.00002L^3-0.008L^2+0.773L-15$. For case 4 the taper angle may be found by computing $t=0.00007L^3-0.0123L^2+0.774L-16$.

FIGS. 5 and 6 also provide maximum and minimum taper angles for a range of loft angles. It will be readily understood that sets of iron-type golf clubs do not necessarily comprise clubs with loft angles that are multiples of five or ten degrees, and that the number designation of an iron-type golf club may not imply a precise loft angle. Even within the product lines of a single manufacturer, for example, a 6-iron might have a loft of 29°, 30° or 30.5°, depending on the construction of the set.

In one example, appropriate taper angles may be determined for selected loft angles by reference to FIGS. 5 and 6 by interpolating between a pair of tabulated data points. For purposes of this specification, interpolating means identifying a taper angle by calculating the ratio of the difference between a selected loft angle and a reference loft angle compared to the difference between the two adjacent reference loft angles, and applying that ratio to the difference between the taper angles corresponding to the reference loft angles.

For example, consider a 5-iron with a loft angle of 27°, which may be associated with adjacent reference loft angles of 20° and 30°. The difference between adjacent reference loft angles of 20° and 30° in FIG. 5 may be 10°. The selected 5-iron loft angle may be 3/10 or 0.3 lower than the reference loft angle of 30°. The maximum taper angle associated with the reference loft angle of 30° may be 4.25° and the maximum taper angle associated with the reference loft of 20° may be 1.2°. The difference between the maximum taper angles of the references loft angles of 20° and 30° may be about 3°. The maximum taper angle for the selected 5-iron may be $5-(0.3\times3)=4.1°$, which may be rounded to 4°. Similarly, the minimum taper angle for the selected 5-iron may be determined by applying the 0.3 ratio to the total difference between the minimum taper angles of the reference loft angles of 20° and 30° (e.g., −7° and −4°, respectively), which may be 3°. Then the minimum taper angle for the selected 5-iron may be $(-4)-(0.3\times3)=-4.9$, which may be rounded to −5°. Thus a 27° 5-iron may have a taper angle between 4° and −5°.

Similarly, the taper angle for a 5-iron with a loft angle of 27° for a set adapted to the characteristics of case 4 may be determined by interpolation. For example, the difference between adjacent reference loft angles in FIG. 5 is 10 (e.g., loft angles of 20° and 30°), and the selected 5-iron loft is 3/10 or 0.3 lower than the 30° reference loft angle. The taper angle associated with a loft angle of 30° is −2° and the taper angle associated with a loft angle of 20° is −5, which provides a difference of 3°. Accordingly, the taper angle for the selected 5-iron is $(-2)-(0.3\times3)=-2.9°$, which may be rounded to −3°. The methods, apparatus, and articles of manufacture described herein are not limited in this regard.

Rather than interpolate from the tabulated relationships in FIG. 6, the approximate maximum and minimum taper angle corresponding to a particular loft angle may be found from the graph of FIG. 5. Additionally, the curvilinear relationships shown in FIG. 5 for maximum taper angle and minimum taper angle for a given loft angle may be estimated by equations. For the maximum taper angles the relationship between taper angle t (in degrees) and loft angle L (in degrees) may be estimated as $t=-0.0035L^2+0.441L-6$. For minimum taper angles, the relationship is $t=-0.0048L^2+0.561L-16$.

The range of potential taper angles for a given loft angle may preferably be narrowed in some sets of clubs, with the maximum taper angle represented by $t=-0.0035L^2+0.441L-8$ and the minimum taper angle represented by $t=-0.0048L^2+0.561L-14$. A more preferable range for some sets of clubs may be represented by a maximum taper angle of $t=-0.0035L^2+0.441L-9$ and a minimum taper angle of $t=-0.0048L^2+0.561L-13$. The methods, apparatus, and articles of manufacture described herein are not limited in this regard.

Figures 7, 8:
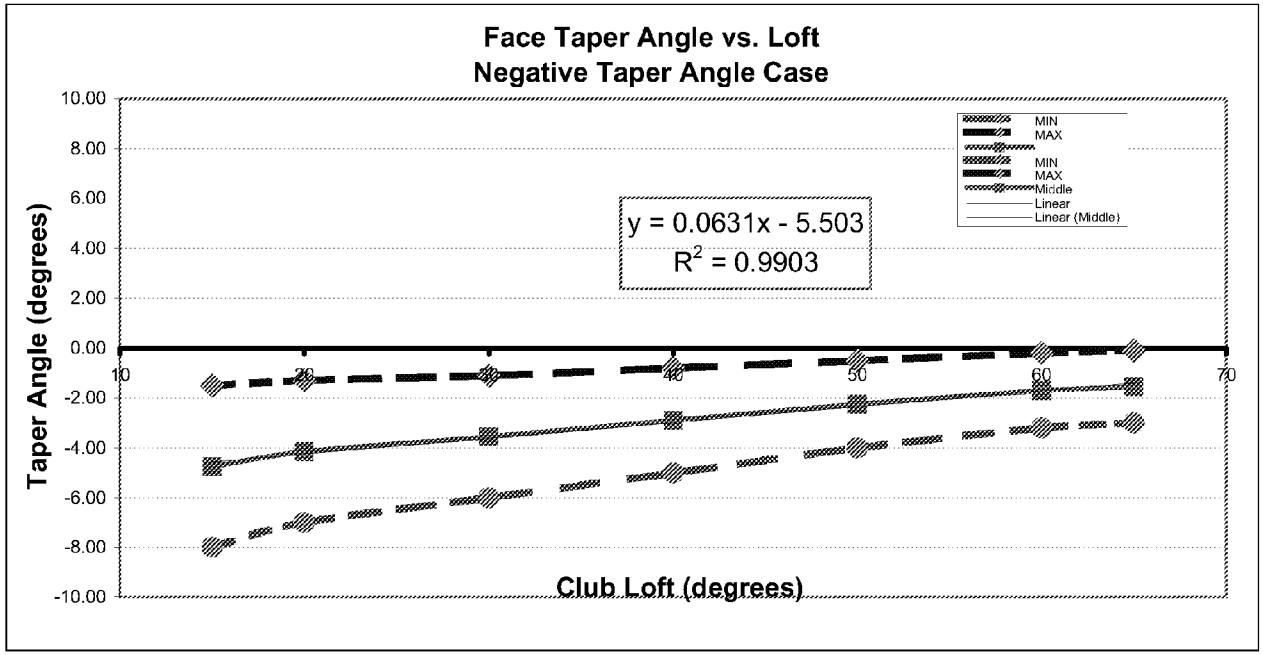
FIG. 7 is a table associated with another example of club loft and taper angle.
FIG. 8 is a graphical representation of the data in FIG. 7.

A second table of sample ranges of taper angles versus loft angles is shown in FIG. 7. Again, in each designated case, seven representative loft angles are paired with corresponding taper angles. In this example, a set of iron-type golf clubs may be configured by selecting loft angles of 15°, 20°, 30°, 40°, 50°, 60°, and 65° for the individual. Again, the number of clubs and the loft angle of a particular club does not necessarily have to be an even multiple of five or ten degrees as shown in FIG. 7.

FIG. 8 graphically illustrates the taper angle versus loft angle of the clubs in FIG. 7. To determine for a given case, the taper angle corresponding to a selected loft angle (such as 28° for a 6-iron), a value may be extended from the graph of FIG. 8 or determined by interpolating between two set points in FIG. 7. FIGS. 7 and 8 are another example of a set of clubs exhibiting a linear relationship between loft and taper angles. Using the relationship $t=0.063(L)-5.503$, where t is the taper angle in degrees, and L is the loft angle in degrees, all taper angles and their interpolating points in FIG. 8 are negative and do not cross a 0° taper angle no matter which loft angle is used. For example, a 7-iron with a loft angle of 33° in Example 1 of FIG. 8 has a taper angle of −2.2°, which means a portion of the club face (10) at or proximate to the top portion (14) may be smaller than a portion of the club face (10) at or proximate to the bottom portion (15). In this example, both Examples 1 and 2 have linear loft angles of 15°, 20°, 30°, 50°, 60°, and 65°, and negative taper angles for all the clubs. The curvilinear relationships shown in FIG. 8 for the maximum taper angle and minimum taper angle for a given loft angle may be estimated with the equation $t=-0.0028(L^2)+0.3691(L)-3.9569$ for the maximum taper angle, and $t=0.02L-0.275$ for the minimum taper angle. Again, the preferred ranges for the set of clubs exemplified in FIGS. 7 and 8 may be represented by alternative equations where none of the clubs have a tapered angle of 0°.

Figures 9, 10:
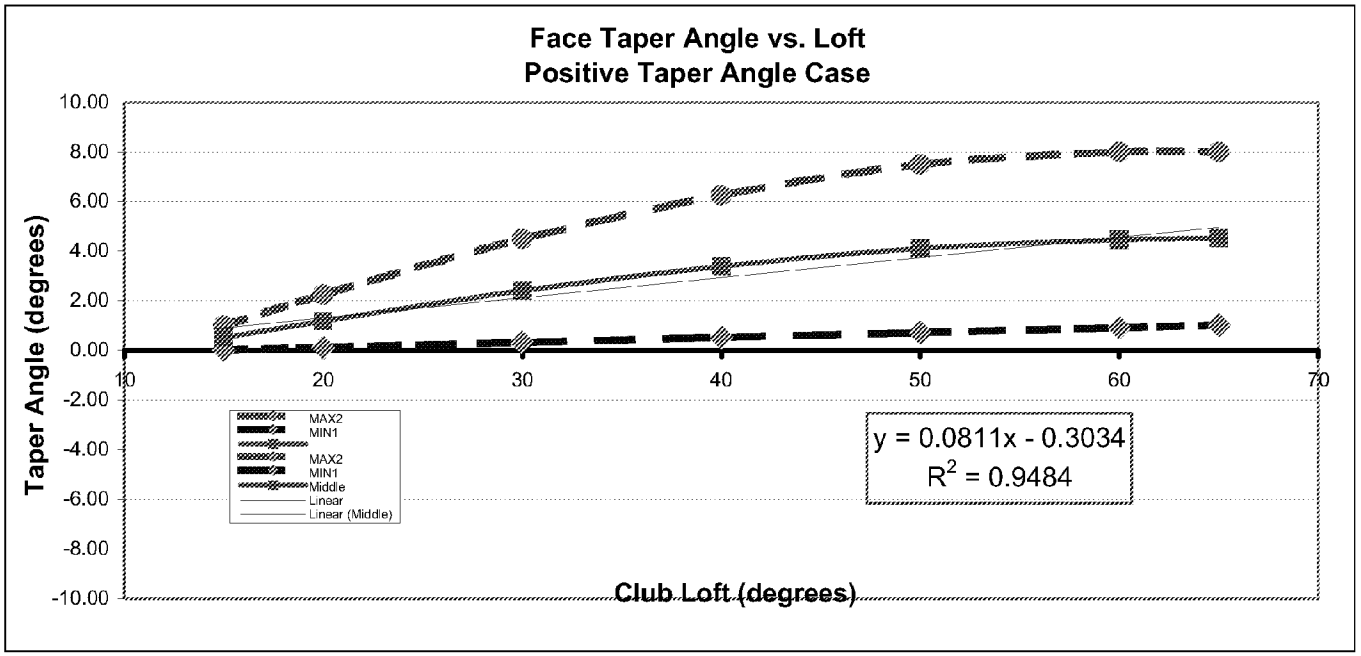
FIG. 9 is a table associated with another example of club loft and taper angle.
FIG. 10 is a graphical representation of the date in FIG. 9.

A third table of sample ranges of taper angles versus loft angles is shown in FIG. 9. Again, in each designated case, seven representative loft angles are paired with corresponding taper angles. In this example, a set of iron-type golf clubs is configured by selecting loft angles of 15°, 20°, 30°, 40°, 50°, 60°, and 65° for the individual.

FIG. 10 graphically illustrates the taper angle versus loft angle of the clubs in FIG. 9. To determine for a given case, the taper angle corresponding to a selected loft angle (such as 30° for a 6-iron), a value may be extended from the graph of FIG. 10 or determined by interpolating between two set points in FIG. 9. FIGS. 9 and 10 are another example of a set of clubs exhibiting a linear relationship between loft and taper angles. Using the relationship $t=0.081(L)-0.303$, where t is the taper angle in degrees, and L is the loft angle in degrees, all taper angles and their interpolating points in FIG. 10 are positive and do not cross a 0° taper angle no matter which loft angle is used. For example, a 7-iron with a loft angle of 33° in Example 1 of FIG. 10 has a taper angle of 1.8°, which means a portion of the club face (10) at or proximate to the top portion (14) may be larger than a portion of the club face (10) at or proximate to the bottom portion (15). In this example, both Examples 1 and 2 have linear loft angles of 15°, 20°, 30°, 50°, 60°, and 65°, and positive taper angles for all the clubs. The curvilinear relationships shown in FIG. 10 for the maximum taper angle and minimum taper angle for a given loft angle may be estimated with the equation $t=0.028(L)-1.9057$ for the maximum taper angle, and $t=-0.0008(L^2)+0.1624(L)-10.126$ for the minimum taper angle. Again, the preferred ranges for the set of clubs exemplified in FIGS. 9 and 10 may be represented by alternative equations where none of the clubs have a tapered angle of 0°.

Although the above examples may be described with respect to iron-type golf clubs, the methods, apparatus, and articles of manufacture described herein may be applicable to other types of golf clubs such as wedge-type golf clubs, hybrid-types golf clubs, etc.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to the extent required by the appended claims and the rules and principles of applicable law.

What is claimed is:

1. A set of golf clubs comprising a plurality of golf clubs, each club having a selected loft angle different from that of each other club in the set;

a face for striking a ball, comprising a front surface, a rear surface, a top portion and a bottom portion; and a taper angle defining the orientation of the rear surface of the face relative to the front surface of the face; wherein the taper angle t in degrees for any loft angle L in degrees is determined by the relationship $t=0.00002L^3-0.008L^2+0.773L-15$.

2. The set of golf clubs of claim 1, wherein the plurality of golf clubs comprises at least one of a plurality of iron-type golf clubs, a plurality of wedge-type golf clubs, or a plurality of hybrids-type golf clubs.

3. The set of golf clubs of claim 1, wherein the plurality of golf clubs comprise at least five clubs.

4. The set of golf clubs of claim 1, wherein the plurality of golf clubs comprises at least eight clubs.

5. The set of golf clubs of claim 1, wherein a club with a loft angle of 15 has a taper angle is about −5.14;

a club with a loft angle of 20 has a taper angle is about −2.58;

a club with a loft angle of 30 has a taper angle is about 1.53;

a club with a loft angle of 40 has a taper angle is about 4.40;

a club with a loft angle of 50 has a taper angle is about 6.15;

a club with a loft angle of 60 has a taper angle is about 6.90;

a club with a loft angle of 65 has a taper angle is about 6.94;

for a club with a loft angle between 15 and 20 the taper angle is determined by interpolation;

for a club with a loft angle between 20 and 30 the taper angle is determined by interpolation;

for a club with a loft angle between 30 and 40 the taper angle is determined by interpolation;

for a club with a loft angle between 40 and 50 the taper angle is determined by interpolation;

for a club with a loft angle between 50 and 60 the taper angle is determined by interpolation; and for a club with a loft angle between 60 and 65 the taper angle is determined by interpolation.

6. The set of golf clubs of claim 1, wherein none of the golf clubs have a tapered angle of 0°.

* * * * *